US005460175A

United States Patent [19]

Foote et al.

[11] Patent Number: 5,460,175

[45] Date of Patent: Oct. 24, 1995

[54] AIR-OXYGEN MIXTURE CONTROLLERS FOR BREATHING DEMAND REGULATORS

[75] Inventors: James C. Foote, Yeovil; Derrick J. Puplett, Sherborne; Alec J. Aldworth, Charmouth, all of England

[73] Assignee: Normalair-Garrett (Holdings) Limited, Yeovil, England

[21] Appl. No.: 155,517

[22] Filed: Nov. 22, 1993

[30] Foreign Application Priority Data

Nov. 26, 1992 [GB] United Kingdom ..... 9224797

[51] Int. Cl.[6] ..... A62B 7/14

[52] U.S. Cl. ..... 128/205.24; 128/205.11; 128/204.29

[58] Field of Search ..... 128/202.26, 204.25, 128/205.11, 205.24, 204.29; 137/908

[56] References Cited

U.S. PATENT DOCUMENTS

| | | | |
|---|---|---|---|
| 4,282,870 | 8/1981 | Porlier | 128/203.14 |
| 4,651,728 | 3/1987 | Gupta et al. | 128/201.28 |
| 4,823,593 | 4/1989 | Furlong et al. | 73/23 |
| 4,856,507 | 8/1989 | Ouillon et al. | 128/204.26 |
| 4,919,124 | 4/1990 | Stevenson et al. | 128/202.26 |
| 4,928,682 | 5/1990 | Stevenson et al. | 128/202.26 |
| 4,960,119 | 10/1990 | Hamlin | 128/204.18 |
| 5,199,423 | 4/1993 | Harral et al. | 128/202.26 |
| 5,269,295 | 12/1993 | Foote et al. | 128/204.18 |

FOREIGN PATENT DOCUMENTS

| | | |
|---|---|---|
| 0078644 | 6/1987 | European Pat. Off. . |
| 0263677 | 4/1988 | European Pat. Off. . |

*Primary Examiner*—Edgar S. Burr
*Assistant Examiner*—William J. Deane, Jr.
*Attorney, Agent, or Firm*—Larson & Taylor

[57] ABSTRACT

Air-oxygen mixture control apparatus includes a pressure control valve arrangement for substantially equalizing the pressures of oxygen and air supplied to the apparatus at variable pressures. A volume flow control arrangement produces volume flows of oxygen and air appropriate for mixing to provide gas of desired oxygen concentration to a breathing demand regulator for breathing by an aircraft aircrew member. An aneroid acts to occlude the supply of air when the aircrew member is exposed to low aircraft ambient atmospheric pressure so that undiluted oxygen is made available for breathing. The apparatus overcomes the problem of mixing oxygen with air when either one or both is supplied from a variable pressure source, such as is the case when high pressure air from a compressor stage of a gas turbine engine is used for dilution purposes.

11 Claims, 2 Drawing Sheets

AIR-OXYGEN MIXTURE CONTROLLERS FOR BREATHING DEMAND REGULATORS

BACKGROUND OF THE INVENTION

1. Field of the Invention

This invention relates to mixture controllers for controlling mixing of air with oxygen in obtainment of breathing gas of desired oxygen enrichment and is more particularly concerned with mixture control apparatus for use with a breathing demand regulator in supplying breathing gas to an aircraft aircrew member.

2. Description of the Prior Art

When an aircraft aircrew member is exposed to low ambient atmospheric pressure at high altitude, such as is the case when an aircraft having a pressurised cabin suffers a cabin decompression above 9000 meters, to provide sufficient oxygen partial pressure to prevent hypoxia, breathing gas delivered to a face mask by way of a breathing demand regulator must comprise substantially 100% oxygen. During flight at altitudes below 9000 meters, however, it is desirable to reduce the concentration of oxygen in the breathing gas so as to provide sufficient nitrogen partial pressure to prevent atelectasis.

Breathing demand regulators are known which include a facility for entrainment of air to reduce the content of oxygen in breathing gas when the source supplying breathing gas to the regulator is one which delivers substantially 100% oxygen such as liquid oxygen system or, as is more usual in modern day aircraft, an aircraft on-board oxygen generating system (OBOGS) in which oxygen-enriched product gas is derived from a molecular sieve oxygen concentrator (MSOC). Whilst molecular sieve beds of the MSOC may be cycled to produce product gas enriched with oxygen to a concentration appropriate to maintaining oxygen partial pressure in the product gas at a constant value substantially equivalent to sea level partial pressure of oxygen in air, it is a requirement in some aircraft aircrew breathing systems that the MSOC be controlled to produce product gas of maximum concentration, usually between 90% and 95% oxygen, and that this be diluted with air in the breathing regulator to provide breathing gas of desired oxygen concentration.

U.S. Pat. No. 4,928,682 (Normalair-Garrett) is one example of a disclosure of a breathing demand regulator having a facility for entrainment of air to mix with OBOGS product gas of maximum oxygen enrichment. The source of air is aircraft cabin air which is induced to enter the regulator past a spring loaded check valve by an injector arrangement. To obtain the correct percentage mix of air with the OBOGS product gas the load at which the check valve cracks open must be maintained within very close limits. This does not present a problem when the air source is pressurised aircraft cabin air; however there now exists a requirement for filtered high pressure air bled from the compressor stage of the aircraft gas turbine engine to be used as the air source for mixing with OBOGS product gas. This presents a problem in a regulator such as is disclosed by U.S. Pat. No. 4,928,682 because satisfactory operation of the check valve cannot be obtained with the wide pressure range of engine compressor bleed air, typically 240 to 1030 kPa (35 to 150 psig).

Also, the source of air supplied to the MSOC is generally high pressure air bled from a compressor stage of a gas turbine engine, which air will also vary in pressure with demands made on the engine. As a result the pressure of product gas delivered by the MSOC will also fluctuate.

SUMMARY OF THE INVENTION

It is an object of the present invention to provide mixture control apparatus which can accept variable pressure air for mixing with variable pressure oxygen to provide breathing gas of appropriate oxygen enrichment to a breathing demand regulator for breathing by an aircrew member during normal flight operation of an aircraft.

In one aspect of the invention this object is met by an air-oxygen mixture control apparatus comprising a body portion, a first inlet in said body portion adapted for connection to a source of oxygen product gas at variable pressure, a second inlet in said body portion adapted for connection to a source of air at variable pressure, an outlet in said body portion adapted for communication with a breathing demand regulator, passage means in said body portion for communicating said first and second inlets with said outlet, mixture control means incorporated in said passage means for controlling mixing of air with oxygen product gas whereby breathing gas of a desired oxygen concentration is made available at the outlet for delivery to an aircraft aircrew member during flight when the aircrew member is not exposed to low aircraft ambient atmospheric pressure, and means incorporated in said passage means for occluding the supply of air for mixing with oxygen product gas when the aircrew member is exposed to low ambient atmospheric pressure whereby undiluted oxygen product gas is made available at the outlet, wherein the mixture control means comprises pressure control means for substantially equalising the pressures of oxygen product gas and air, and volume flow control means for controlling volume flows of oxygen product gas and air delivered for mixing so that breathing gas of desired oxygen concentration is made available at the outlet.

If desired the mixture control apparatus may be provided as an integral part of a breathing demand regulator.

In one embodiment of the invention variable pressure air is reduced to a pressure which is substantially that of oxygen product gas by a pressure reducing valve moved towards opening by the action of oxygen product gas pressure, and volume flows of oxygen product gas and air at reduced pressure are controlled by a pair of orifices to produce breathing gas of desired oxygen concentration.

In this embodiment oxygen gas pressure acting to move the pressure reducing valve towards opening is decayed by being bled to ambient by an aneroid controlled valve when the aircrew member is exposed to low aircraft ambient atmospheric pressure and the pressure reducing valve is moved towards closing by the biasing action of a spring so that undiluted oxygen product gas is delivered at the outlet.

In another embodiment of the invention variable pressure air is similarly reduced to a pressure which is substantially that of oxygen product gas at the oxygen product gas inlet before being passed to a pressure balanced valve biased by a spring towards opening a port which is sized with respect to an orifice controlling flow of oxygen product gas to provide a required volume flow of air for mixing with oxygen product gas.

In this embodiment the pressure balanced valve is closed by expanding action of an aneroid which senses exposure to low aircraft ambient atmospheric pressure so that undiluted oxygen product gas is delivered at the outlet.

In a further embodiment of the invention pressures of oxygen product gas and variable pressure air entering respective inlets of the mixture controller are equalised by a pair of poppet valves. A valve head of each valve is carried by a stem projected by a diaphragm mounted valve plate, the effective area of the diaphragm mounted valve plate being substantially equal to the area of the underside of the valve head so that the valves are pressure balanced with respect to the respective oxygen product gas and air inlet pressures. A spring acting between opposed faces of the diaphragm mounted valve plates ensures both valves control at the same pressure.

In this embodiment, after pressure equalisation, volume flows of air and oxygen product gas are controlled by a spool valve to be in a ratio required to provide breathing gas of desired oxygen concentration. The spool valve has a first spool adapted to control flow of oxygen product gas from the oxygen product gas inlet by way of a respective one of the pair of poppet valves to the outlet, and a second spool adapted to control flow of air from the air inlet by way of the other one of the pair of poppet valves to the outlet.

An aneroid sensing exposure to low aircraft ambient atmospheric pressure is adapted to act on the spool valve to move the second spool towards occluding the flow of air to the outlet and to move the first spool towards increasing the flow of oxygen product gas to the outlet whereby undiluted oxygen product gas is made available at the outlet.

In another aspect of the invention an aircrew breathing demand regulator comprises an air inlet and an oxygen-product gas inlet connected with a regulator outlet by way of air-oxygen mixture control apparatus provided integrally with the regulator, the mixture control apparatus comprising means for substantially equalising the pressures of variable pressure air and variable pressure oxygen product gas supplied to the respective inlets, and means for controlling volume flows of air and oxygen product gas delivered for mixing so that breathing gas of desired oxygen concentration is made available to the regulator outlet.

BRIEF DESCRIPTION OF THE DRAWINGS

The invention will now be further described by way of example and with reference to the accompanying drawings in which.

DETAILED DESCRIPTION OF THE DRAWINGS

Figure 1:
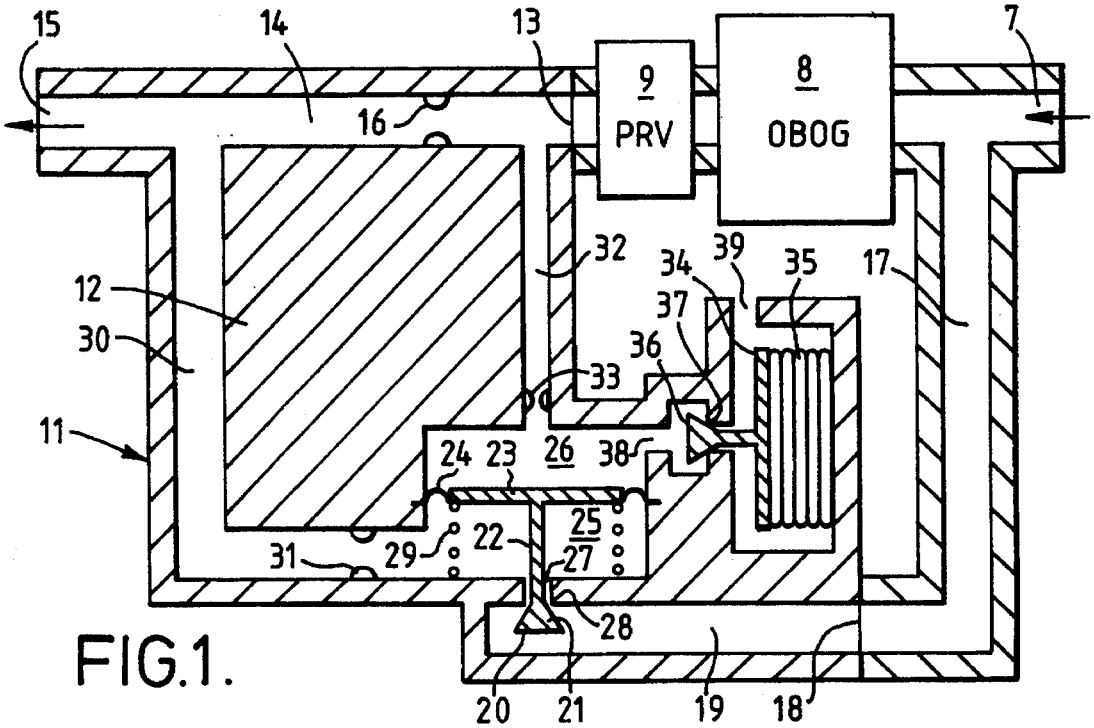
FIG. 1 is a schematic illustration of air-oxygen mixture control apparatus for a breathing demand regulator in accordance with one embodiment of the invention.

Referring first to FIG. 1, filtered high pressure air from a compressor stage of an aircraft gas turbine engine (not shown) is supplied by an air line 7 to an aircraft on-board oxygen generating system (OBOGS) 8. The OBOGS includes a molecular sieve oxygen concentrator (MSOC) such as is disclosed by EP-A-0225736 (Normalair-Garrett). Molecular sieve beds of the MSOC are cycled such that the MSOC delivers product gas of maximum oxygen enrichment, generally 90% to 95% oxygen, which for convenience will hereinafter be referred to as oxygen product gas. The pressure of the oxygen product gas delivered by the OBOGS is reduced by a pressure reducing valve (PRV) 9 to a value in the order of 140 Kpa (20 psig) before being passed to an oxygen inlet 13 of an air-oxygen mixture control apparatus 11 having a body portion 12 which may be provided as an integral part of a breathing demand regulator (not shown) or, alternatively, as a separate unit as illustrated in FIG. 1. A passageway 14 communicates the inlet 13 with an outlet 15 which is adapted for connection to the breathing demand regulator. The passageway 14 incorporates a flow restrictor orifice 16 sized to provide a desired volume flow of oxygen product gas for mixing with air.

A branch air line 17 from the air line 7 connects with an air inlet 18 of the mixture control apparatus 11. The air inlet 18 communicates by a passageway 19 with a pressure reducing valve 20 comprising a valve head 21 carried on a stem 22 projected by a valve plate 23 mounted by a diaphragm 24 from the body portion 12 of the control apparatus 11. The plate 23 and diaphragm 24 combine to separate an air chamber 25 from an oxygen product gas chamber 26. The air chamber 25 is communicated with the passageway 19 by a port 27 having a valve seat 28. The valve head 21 is urged towards closing with the valve seat 23 by a compression spring 29 acting between the body portion and the valve plate 23. The air chamber 25 is further communicated with the passageway 14 downstream of the orifice 16 by a passageway 30 which incorporates an orifice 31 sized to provide a desired volume flow of air for mixing with oxygen product gas.

The oxygen product gas chamber 26 is communicated with passageway 14 upstream of the orifice 16 by a passageway 32 incorporating flow restrictor orifice 33. A valve member 34 carried by an aneroid 35 has a valve head 36 closing with a valve seat 37 provided in a branch passageway 38 from the chamber 26 whereby the chamber 26 may be communicated with an ambient outlet 39 when the valve head is urged away from the valve seat by expansion of the aneroid.

In operation, oxygen product gas delivered by the OBOGS 8 is reduced in pressure by the PRV 9 and flows by way of the inlet 13 through passageway 14, where its volume flow is restricted by the orifice 16, towards the outlet 15. Oxygen product gas also flows by way of passageway 32 into chamber 26 where its pressure acts on the valve plate 23 and diaphragm 24 to overcome the biasing action of spring 29 so that the pressure reducing valve 20 is moved towards opening and filtered high pressure air flows from passageway 19 past valve head 21 into air chamber 25 whereby its pressure is reduced to a value that is substantially that of the oxygen in chamber 26. In practice the pressure in chamber 25 is slightly lower than the pressure in chamber 26 but will follow any pressure change in chamber 26. Air flows from chamber 25 by way of passageway 30 and flow restrictor orifice 31 to mix with oxygen product gas flowing in passageway 14 downstream of the orifice 16. By way of example, in this embodiment, the orifices 16 and 31 are sized to produce a breathing gas mixture that is 75% air and 25% oxygen product gas by volume so that the concentration of oxygen in the breathing gas mixture made available to the breathing demand regulator at the outlet 15 is in the order of 40%, which is acceptable for breathing by an aircrew member in normal flight of an aircraft having a pressurised cabin.

If, during flight above 9000 meters (30,000 ft), the aircraft suffers a cabin decompression so that the aircrew member is exposed to low aircraft ambient atmospheric pressure, the aneroid 35 expands to move the valve head 36 of valve member 34 away from the valve seat 37 whereby oxygen in chamber 26 is vented to ambient by way of passageway 38 and ambient vent 39. Flow of oxygen product gas to ambient is restricted by the orifice 33 so that excessive oxygen product gas is not wasted and pressure is maintained in passageway 14 upstream of orifice 16. With reduced pressure in chamber 26 the bias of compression spring 29 is effective to close the pressure reducing valve 20 so that high pressure air is occluded from entering chamber 25 and undiluted oxygen product gas is made available at the outlet 15.

The outlet 15 is adapted for connection to an inlet of a breathing demand regulator which includes a demand valve (not shown) that opens in response to inhalation breathing effort of an aircrew member to allow breathing gas to flow by way of a regulator outlet to a breathing mask worn by the aircrew member. Whilst the demand valve may be of any suitable configuration it is conveniently a demand valve having a valve head supported by a spindle from a spool which slides in a bore in the regulator body, such a demand valve being used in breathing demand regulators disclosed by EP-A-0263677, EP-A-0078644 and U.S. Pat. No. 4,928,682 (Normalair-Garrett). An advantage of a breathing demand regulator combined with an air-oxygen mixture controller in accordance with the present invention is that an injector arrangement such as forms part of the regulator disclosed by U.S. Pat. No. 4,928,682 is not required.

Figure 2:
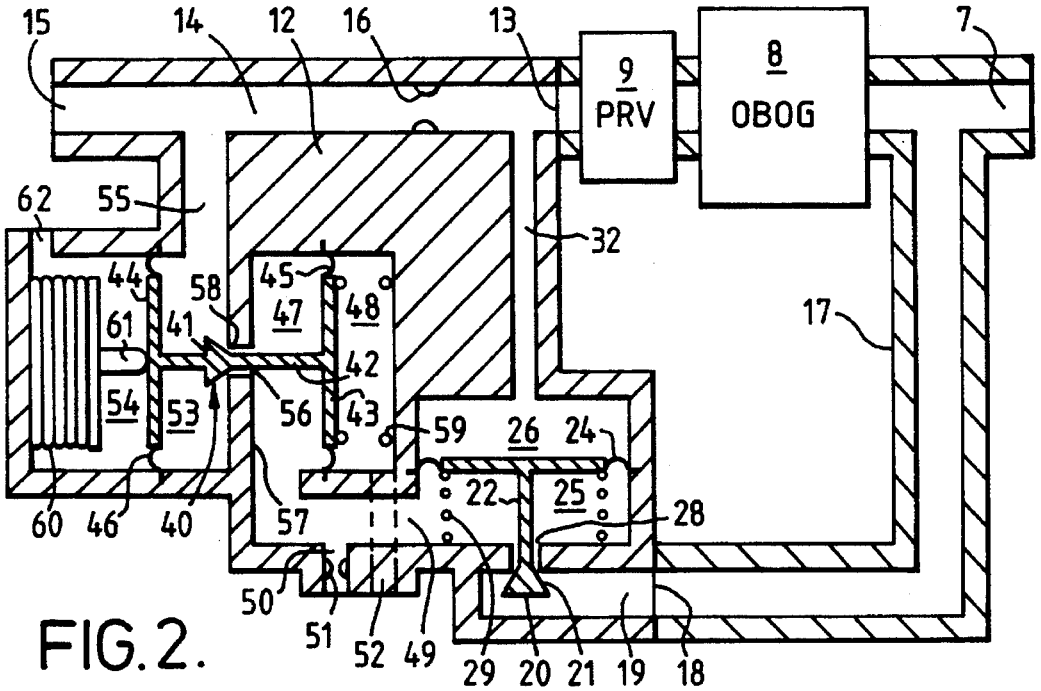
FIG. 2 is a schematic illustration of air-oxygen mixture control apparatus for a breathing demand regulator in accordance with another embodiment of the invention.

The embodiment of the invention illustrated in FIG. 2 is a modified form of the embodiment hereinbefore described with reference to and shown in FIG. 1, and like components are given like reference numerals. In the FIG. 2 embodiment a balanced valve 40 takes the place of the flow restrictor orifice 31 in the FIG. 1 embodiment. The valve 40 comprises a valve head 41 formed on a stem 42 which extends between valve plates 43 and 44 carried by diaphragms 45 and 46, respectively, mounted internally of the body portion 12. The valve plate 43 and diaphragm 45 separate a chamber 47 from a chamber 48. The chamber 47 is communicated by a passageway 49 with chamber 25. The passageway 49 is communicated with ambient by a branch passageway 50 incorporating a restrictor 51. The chamber 48 is communicated with ambient by a passageway 52. The valve plate 44 and diaphragm 46 separate a chamber 53 from a chamber 54. A passageway 55 communicates chamber 53 with the passageway 14 carrying oxygen product gas delivered by the OBOGS 9. A port 56 in a wall 57 of the body portion communicates chamber 47 with chamber 53. A valve seat 58 is provided at that side of the port which faces the valve head 41, the valve head being biased away from the valve seat by a spring 59 located in chamber 48 and acting between the body portion and the valve plate 43. The chamber 54 locates an aneroid 60 which projects a stem 61 into contact with the valve plate 44. A passageway 62 communicates chamber 54 with ambient so that ambient pressure applies in chambers 48 and 54, and the valve 40 is pressure balanced across its opposite end faces.

In operation, oxygen product gas entering the oxygen product gas inlet 13 flows through the passageway 14, a desired volume flow being obtained by the orifice 16. Oxygen product gas also flows into the chamber 26 by way of passageway 32 which in this embodiment is not restricted because chamber 26 is not communicated with ambient during any phase of operation of the regulator. Oxygen product gas pressure in chamber 26 acts on the valve plate 23 and diaphragm 24 to over come the action of spring 29 so that the valve member 20 is moved towards opening. High pressure air in passageway 19 flows past valve head 21 into chamber 25 and, in so doing, its pressure is reduced to a value which is substantially that of the oxygen product gas. Air flows from chamber 25 by way of passageway 49 to chamber 47 and then through port 56 into chamber 53, the valve head 41 being held off valve seat 58 by the combined action of spring 59 and the pressure of oxygen product gas acting on the valve plate 44 and diaphragm 46. The fully open area of port 56 is sized so that the volume flow of air delivered by way of passageway 55 for mixing with the volume flow of oxygen product gas in passageway 14 is such as to provide breathing gas of required oxygen concentration, in this embodiment 40% oxygen concentration, for delivery to the breathing demand regulator during normal flight operations. Should the aircraft suffer a cabin decompression, then the aneroid 60 expands to move the pressure reducing valve 40 towards a position in which the valve head 41 is closed with the valve seat 58 at a cabin altitude equivalent to 9000 meters, whereby undiluted oxygen product gas is delivered as breathing gas from the outlet 15.

A feature of this FIG. 2 embodiment is that valve head 41 combines with the port 56 to provide a variable size orifice when the valve head is moved towards closing with the valve seat 58 by the expanding action of the aneroid 60. Thus, if the aneroid is arranged to commence expansion when aircraft cabin pressure is equivalent to an altitude of 4500 meters (15,000 ft), the volume flow of air can be progressively reduced and the percentage concentration of oxygen in the breathing gas available at the outlet can be increased with increasing cabin altitude (decreasing ambient atmospheric pressure), in line with a preferred requirement as shown by curve 3 in FIG. 4.

Figure 4:
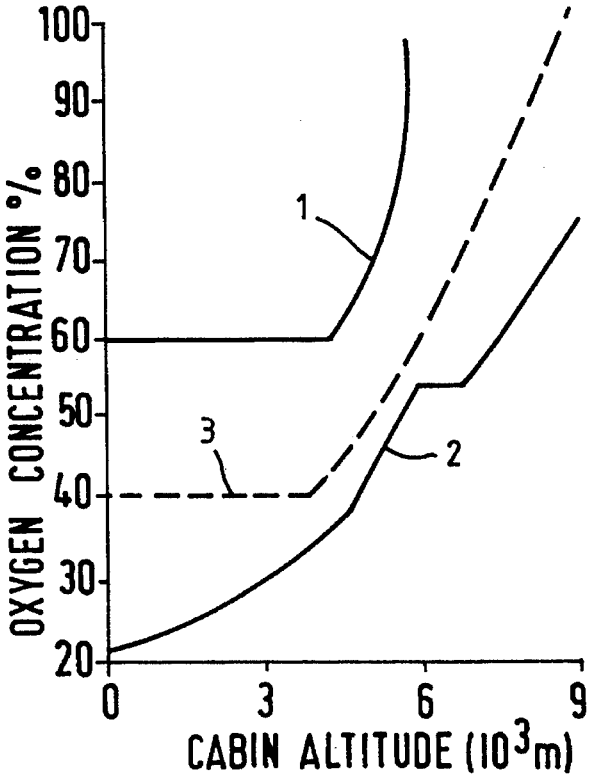
FIG. 4 is a graph illustrating relationships between cabin pressure and aircrew breathing gas oxygen content requirements and provisions for a typical high performance military aircraft.

FIG. 4 of the drawings is a graphical representation of the relationships between cabin pressure and aircrew breathing gas oxygen content requirements and provisions for a modern high performance military aircraft. Oxygen content is expressed as volume percentage concentration and cabin pressure is expressed in terms of altitude in thousands of meters relative to sea level. In this regard, cabin pressure is related, but not linearly, to aircraft altitude as a consequence of cabin pressurisation that is applied in accordance with a pressurisation schedule until a maximum difference in pressure is established between the cabin and the external atmosphere.

The uppermost curve shown by solid line 1 on the graph of FIG. 4 represents the maximum permissible oxygen content for the breathing gas at various cabin altitudes. For the reasons that have been discussed the permissible maximum from sea level up to a cabin altitude of 4500 meters (15,000 ft) is 60%; thereafter the permissible oxygen content rises linearly with cabin altitude to a value of 80% at 6100 meters (20,000 ft). At cabin altitudes above this level there is no maximum limit for oxygen content in the breathing gas.

The lowermost curve shown by solid line 2 in the graph of FIG. 4 represents the minimum oxygen content for the breathing gas as determined by physiological and other requirements as above discussed. It will be noted that this curve has four distinct sections, a lower section covering the cabin altitude range from sea level up to 4500 meters where the curve is essentially a plot of constant oxygen partial pressure at sea level equivalent. The section of curve 2 between cabin altitudes of 4500 meters and 6100 meters rises linearly and more steeply than a plot of constant oxygen partial pressure, the reason for the enhanced oxygen content requirement over this range of cabin altitude being the need to provide for the effects of rapid depressurisation. In the cabin altitude range 6100 to 7000 meters, the minimum required oxygen content remains constant at about 55%, whereafter the minimum required content rises with cabin altitude as a continuation of the sea level equivalent partial pressure curve because at the cabin altitudes concerned the sea level partial pressure provides the minimum oxygen content to meet the rapid depressurisation requirement.

The curve represented by broken line 3 in FIG. 4 represents a plot of oxygen concentration in breathing gas delivered by a breathing demand regulator having facility for mixing air with oxygen, that should ideally be followed to maximise protection of an aircrew member against increasing aircraft cabin altitude (i.e. exposure to decreasing aircraft ambient atmospheric pressure).

In the embodiment of FIG. 2, the aneroid can be arranged to commence expansion at an aircraft cabin altitude of 3800 meters (12,500 ft) so that the volume flow of air through port 56 is progressively reduced and the oxygen concentration of the breathing gas increased in line with curve 3.

Figure 3:
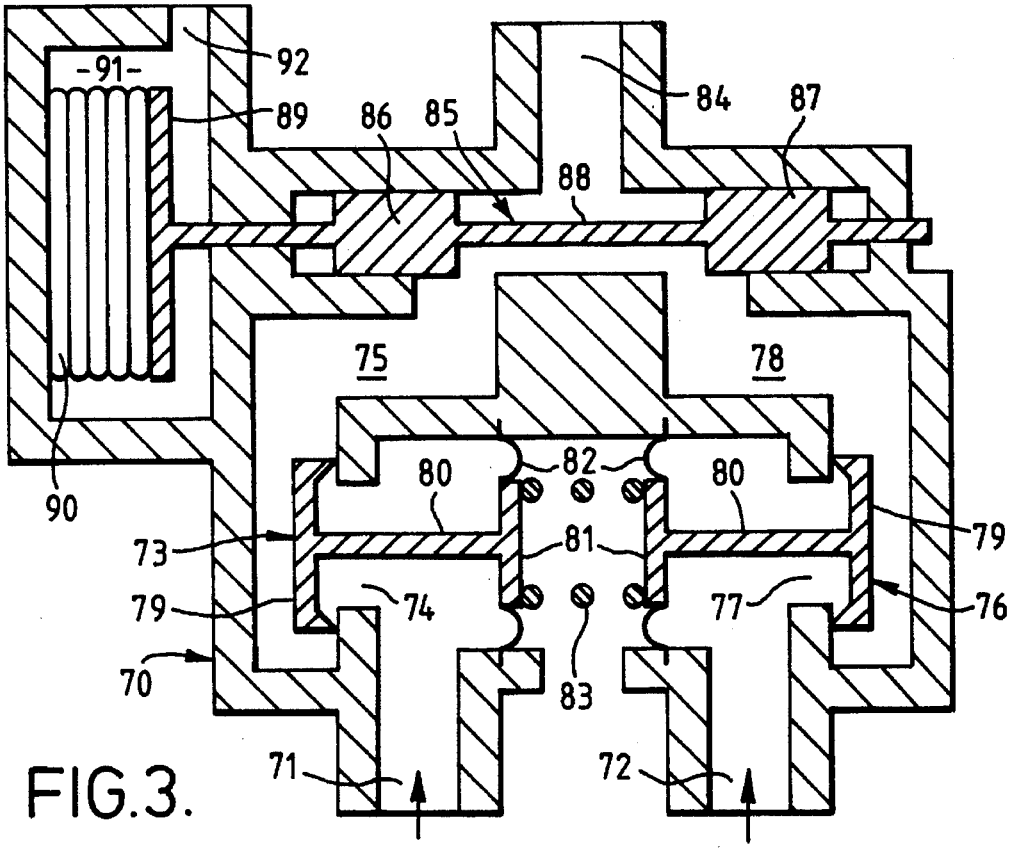
FIG. 3 is a schematic illustration of air-oxygen mixture control apparatus for a breathing demand regulator in accordance with a further embodiment of the invention.

Mixture control apparatus 70, as illustrated in FIG. 3, has an air inlet 71 and an oxygen product gas inlet 72. A poppet valve 73 is adapted for closing a port 74 communicating the air inlet 71 with a passageway 75. A poppet valve 76 is similarly adapted for closing a port 77 communicating the oxygen product gas inlet 72 with a passageway 78. Each of the poppet valves 73 and 76 comprise a valve head 79 carried by a valve stem 80 projected by a valve plate 81 mounted from the regulator body by a diaphragm 82. A compression spring 83 acts between opposed faces of the valve plates 81. At their downstream ends the passageways 75 and 78 communicate with an outlet 84 which is adapted for connection to a breathing demand regulator (not shown). Communication between passageway 75 and 78, and outlet 84 is controlled by a double spool valve member 85. The spool valve member 85 has spools 86 and 87 carried on a spindle 88 projected by a plate 89 that is adapted to be contacted by an aneroid 90 for movement of the spool valve member. The aneroid is located in a chamber 91 which is communicated by an opening 92 with aircraft cabin pressure. The spool 86 controls communication between passageways 75 and outlet 84, and the spool 87 controls communication between passageway 78 and outlet 84.

In operation of the mixture controller 70, the inlet 71 is connected for receiving variable pressure air from a high pressure source, generally a compressor stage of an aircraft gas turbine engine, the air being filtered and, if required, reduced in pressure by a pressure reducing valve. The inlet 72 is connected for receiving variable pressure oxygen product gas of maximum oxygen enrichment from an OBOGS (not shown) which may also be reduced in pressure by a pressure reducing valve. The effective area of the valve plate 81 and diaphragm 82 of each of the poppet valves 73, 76 is equal to the effective area of the underside of the valve heads 79 so that the spring 83 acts to ensure both valves control at the same pressure in permitting air and oxygen product gas to flow in passageways 75 and 78, respectively, the valves being held closed by the pressures in the passageways 75 and 78 when a demand valve of the regulator is closed. During normal aircraft flight with the cabin pressurised, the spools 86 and 87 are so positioned as to control the flow of air and oxygen product gas from passageways 75 and 78 to be in desired proportions, generally 75% air and 25% oxygen by volume, whereby breathing gas of desired oxygen concentration is made available at the outlet of the mixture controller. If the aircraft suffers a cabin decompression when flying at high altitude, generally in excess of 9000 meters, this is sensed by the aneroid 90 which expands to move the spool valve member 85 such that spool 86 closes communication between passageway 75 and outlet 84, and spool 87 moves towards increasing communication between passageway 78 and outlet 84 whereby undiluted oxygen product gas is made available at the outlet.

What is claimed is:

1. Air-oxygen mixture control apparatus comprising a body portion, a first inlet in said body portion adapted for connection to a source of oxygen product gas at variable pressure, a second inlet in said body portion adapted for connection to a source of air at variable pressure, an outlet in said body portion adapted for communication with a breathing demand regulator, passage means in said body portion for communicating said first and second inlets with said outlet, mixture control means incorporated in said passage means, said mixture control means comprising pressure control means for substantially equalising the pressures of oxygen product gas and air, and volume flow control means for controlling volume flows of oxygen product gas and air delivered for mixing so that breathing gas of desired oxygen concentration is made available at the outlet for delivery to an aircrew member during flight when the aircrew member is not exposed to low aircraft ambient atmospheric pressure, and means incorporated in said passage means for occluding the supply of air from mixing with oxygen product gas when the aircrew member is exposed to low ambient atmospheric pressure so that undiluted oxygen product gas is made available at the outlet for delivery to the aircrew member.

2. Apparatus according to claim 1, wherein said pressure control means comprise a pressure reducing valve in a passageway, a variable pressure air inlet communicating with said outlet, said pressure reducing valve being biased towards opening by the action of oxygen product gas pressure whereby the pressure of the variable pressure air is substantially equalised with the pressure of the oxygen product gas.

3. Apparatus according to claim 2, wherein the volume control means comprises a pair of orifices located one in a passageway communicating said oxygen product gas inlet with said outlet and one downstream of said pressure reducing valve in said passageway communicating said variable pressure air inlet with said outlet.

4. Apparatus according to claim 2, wherein said volume flow control means comprises a pressure balanced valve, a spring and a port, said spring being biased towards opening said port, said variable pressure air inlet communicating with said outlet and an orifice communicating said oxygen product gas inlet with said outlet, said port being sized with respect to said orifice to provide a required volume flow of air for mixing with oxygen product gas.

5. Apparatus according to claim 2, wherein said means for occluding the supply of air for mixing with oxygen product gas comprises an aneroid valve biased towards opening by expansion of said aneroid sensing exposure to low ambient atmospheric pressure to decay oxygen product gas pressure tending to move the pressure reducing valve towards opening.

6. Apparatus according to claim 4, wherein said means for occluding the supply of air for mixing with oxygen product gas comprises an aneroid adapted for moving said pressure balanced valve towards closing against the action of said spring.

7. Apparatus according to claim 1, wherein said pressure control means comprises a pair of poppet valves co-operating one with said oxygen product gas inlet and one with said variable pressure air inlet.

8. Apparatus according to claim 7, wherein each said poppet valve comprises a valve head carried by a stem projected by a valve plate supported from the body portion by a diaphragm, the effective area of the diaphragm supported valve plate being equal to the area of the opposed underside of the valve head whereby the poppet valves are pressure balanced with respect to the respective oxygen product gas and air inlet pressures, and spring means acting between opposed faces of said diaphragm mounted valve plates.

9. Apparatus according to claim 7, wherein said volume flow control means comprises a spool valve having a first spool adapted to control flow of oxygen product gas from the oxygen product gas inlet by way of a respective one of said poppet valves to said outlet, and a second spool adapted to control flow of air from the variable pressure air inlet by way of said other poppet valve to said outlet.

10. Apparatus according to claim 8, wherein said means for occluding the supply of air for mixing with product gas comprises an aneroid adapted to act on the spool valve to move the second spool towards occluding the flow of air to the outlet and to move the first spool towards increasing the flow of oxygen product gas to the outlet.

11. Apparatus according to claim 1 formed integrally with an aircrew breathing demand regulator.

* * * * *